US006595770B2

(12) United States Patent
Hsu

(10) Patent No.: US 6,595,770 B2
(45) Date of Patent: Jul. 22, 2003

(54) SAFETY DEVICE FOR IGNITION GUN

(76) Inventor: Chin-Mei Hsu, 3Fl., No. 53, Lane 80, Sec. 4, Cheng-Te Road, Taipei (TW)

( * ) Notice: Subject to any disclaimer, the term of this patent is extended or adjusted under 35 U.S.C. 154(b) by 20 days.

(21) Appl. No.: 10/023,853

(22) Filed: Dec. 21, 2001

(65) Prior Publication Data

US 2003/0118961 A1 Jun. 26, 2003

(51) Int. Cl.[7] ..... F23D 11/36
(52) U.S. Cl. ..... 431/153
(58) Field of Search ..... 431/153, 255, 431/344; 126/405, 406, 407, 413, 414

(56) References Cited

U.S. PATENT DOCUMENTS 5,531,592 A * 7/1996 Tasi ..... 431/255
5,662,466 A * 9/1997 Cheng ..... 431/153
5,697,775 A * 12/1997 Saito et al. ..... 431/153
6,050,810 A * 4/2000 Huang ..... 431/153
6,231,335 B1 * 5/2001 Huang ..... 431/153

FOREIGN PATENT DOCUMENTS

WO WO 99/47855 A1 * 9/1999 ..... F23D/11/36
WO WO 99/60309 A2 * 11/1999

* cited by examiner

*Primary Examiner*—Henry Bennett
*Assistant Examiner*—Josiah Cocks
(74) *Attorney, Agent, or Firm*—Browdy and Neimark, P.L.L.C.

(57) ABSTRACT

A safety device for ignition gun mainly has a knob, a push button, a spring, and a reed piece, disposed in the housing of an ignition gun, in which both the knob and the push button are slidable relatively to the housing while the reed piece is fixedly positioned in the housing; and the spring is arranged between a base, which is jointed to the push button, and the housing structure such that a projecting portion of the base confronts against a bottom edge of the knob to keep the knob immovable under normal conditions. When the push button is pushed to have the projecting portion checked by a barb of the reed piece, the projecting portion is meanwhile released from the bondage of the knob such that the knob would become depressible, and during a depression travel of the knob, the reed piece is depressed and the barb would depart from the projecting portion to restore the push button to its original position.

1 Claim, 6 Drawing Sheets

SAFETY DEVICE FOR IGNITION GUN

FIELD OF THE INVENTION

This invention relates to a safety device for ignition gun that can prevent any accidental trigger so as to protect people, particularly kids, against dangers.

BACKGROUND OF THE INVENTION

Many kinds of ignition guns are available for use in kitchens, etc., in which a style of ignition gun has combined with a generic gas lighter that provides its inside liquefied gas to the gun as fuel.

The housing of the ignition gun of this style is designed openable for receiving a gas lighter, and is provided with a knob and a spout. When the knob is depressed, an interlinked component located beneath is driven to trigger the gas lighter and open a gas valve thereof for releasing the inside fuel for igniting and generating a flame at the spout.

Since there is no safety device arranged in the mentioned conventional ignition gun, it might incur accidental dangers when a kid is playing such a gun. For eliminating this defect, this invention is proposed to provide a safety device for controlling the knob and enhancing the operation safety of the ignition gun.

SUMMARY OF THE INVENTION

The primary object of this invention is to provide a safety device for ignition gun, in which a knob and a push button are provided to the housing of an ignition gun, in which the knob is used for controlling ignition switch of a gas lighter while the push button for controlling the availability of the knob to thereby ensure the safety of the ignition gun.

In order to realize abovesaid objects, the housing of the safety device is provided with a knob and a push button. The push button is combined with a base having a projecting portion and a spring is arranged between the base and the housing structure of the ignition gun. If no external force is applied, the elastic force of the spring is applied on the push button to confront the projecting portion against the bottom edge of the knob to make the latter unavailable. Besides, a reed piece having a barb is also disposed in the housing. After the push button has been push forwards to have one end of the projecting portion checked by the barb of the reed piece and meanwhile the projecting portion detached from the bottom edge of the knob, a user might depress the knob for ignition. During depression travel of the knob, the reed piece is depressed simultaneously such that the barb would escape from the checking of the projecting portion to restore the push button by taking advantage of the restoring force of the spring applied upon the base to prevent the knob from being depressed again to avoid any mistaken depression of the knob.

For more detailed information regarding advantages or features of this invention, at least an example of preferred embodiment will be fully described below with reference to the annexed drawings.

BRIEF DESCRIPTION OF THE DRAWINGS

The related drawings in connection with the detailed description of this invention to be made later are described briefly as follows, in which.

DETAILED DESCRIPTION OF THE INVENTION

Figure 1:
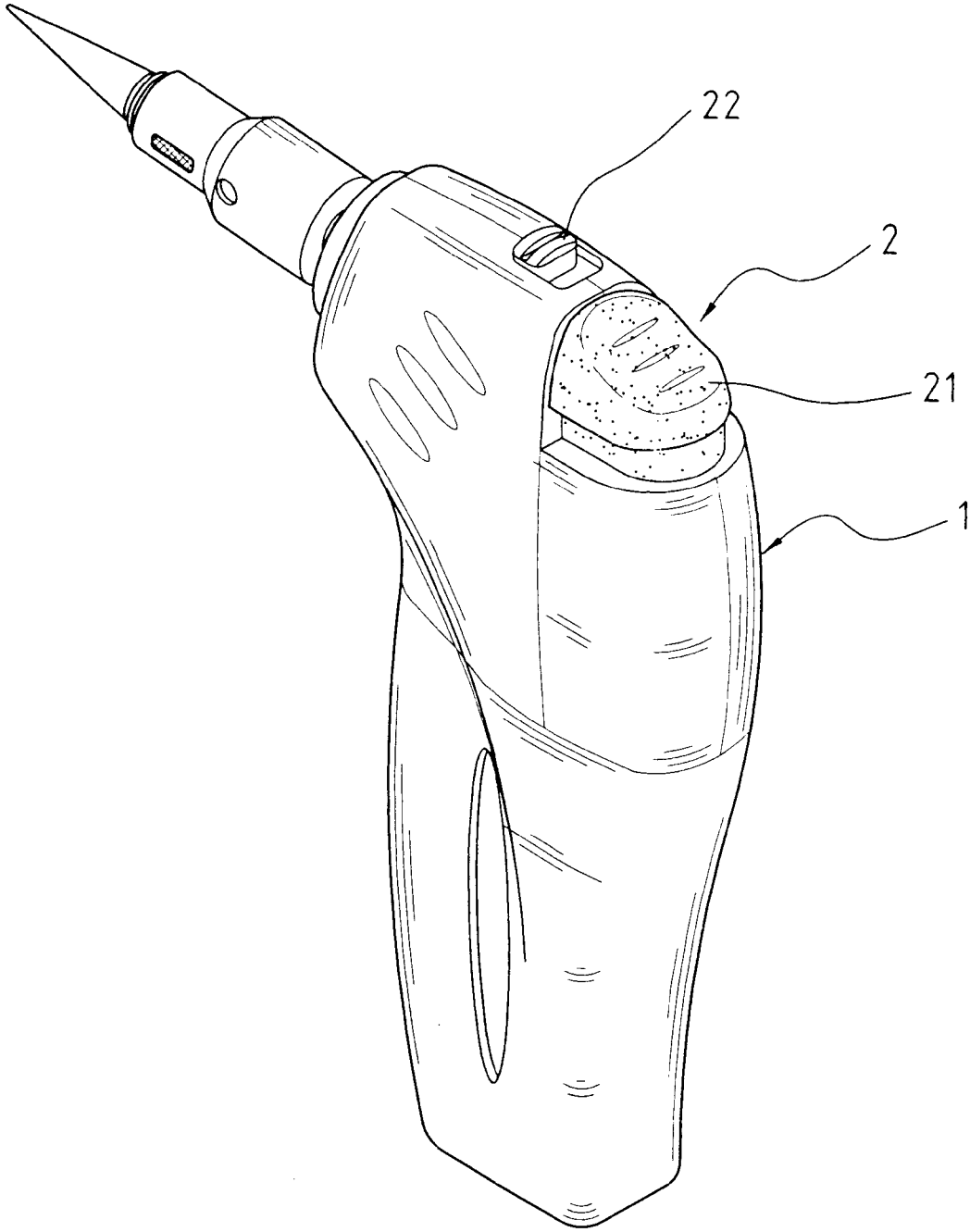
FIG. 1 is a three-dimensional view of an ignition gun equipped with a safety device of this invention.

As indicated in FIG. 1 of this invention, a safety device 2 is disposed on the top end of the housing 1 of an ignition gun, in which the safety device 2 further, comprises a knob 21 and a push button 22, in which the knob 21 is arranged for ignition purpose while the push button 22 is designed for controlling operability of the knob 21.

Figure 2:
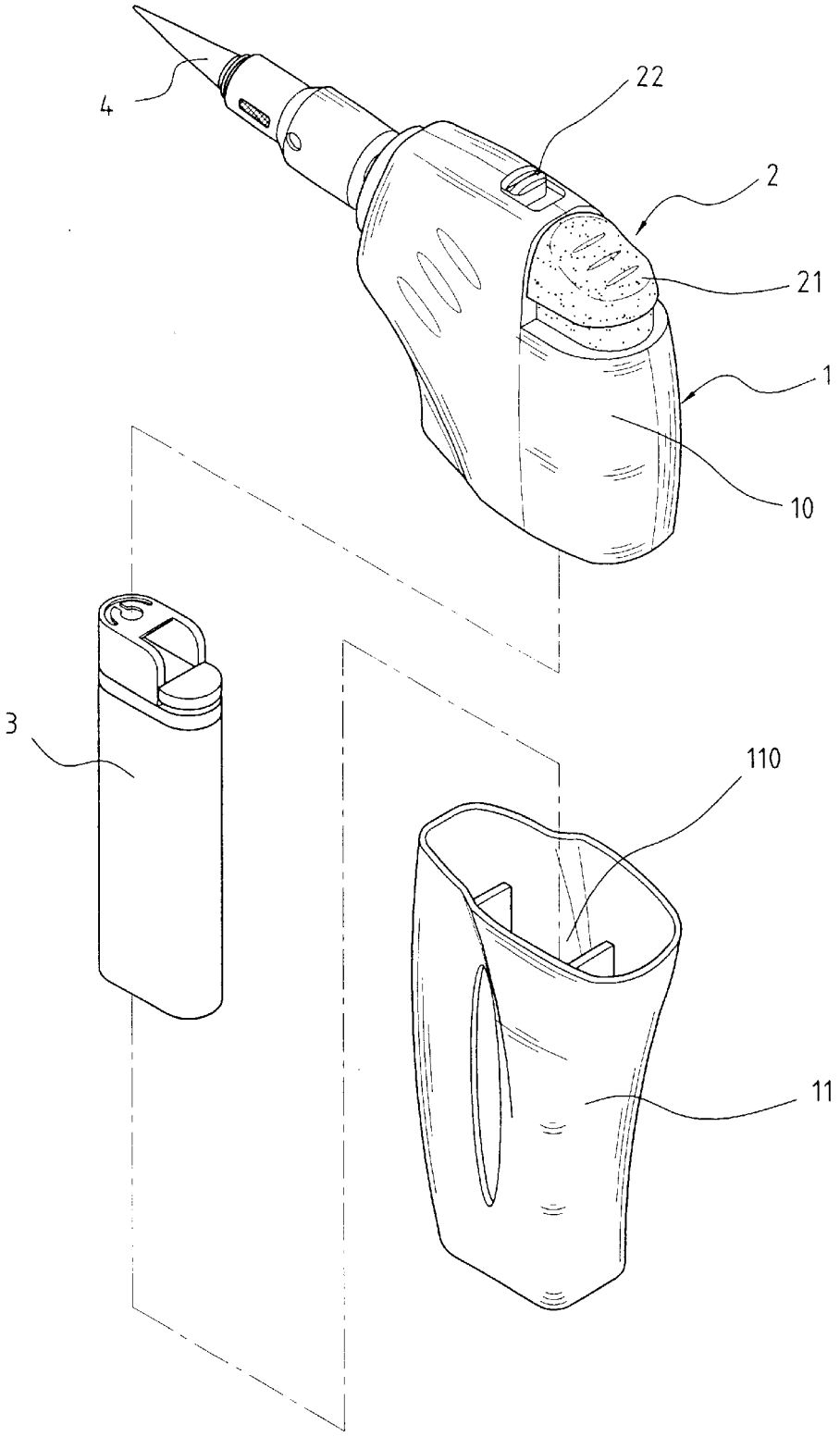
FIG. 2 is an exploded view in three dimensions showing a gas lighter to be inserted in the housing of this invention.

With reference to FIG. 2, the housing 1 further comprises a top and a bottom hollow casing 10, 11 for reception of an article, in which the inner space 110 of the bottom casing 11 is formed for accommodating a generic gas lighter 3 obtainable in the market, while a knob 21 and a push button 22 are located on the top end of the top casing 10; and a flame spout 12 at the front end of the top casing 10 might jointedly receive a soldering iron head 4, where the flame spout 12 will spout flame to heat a soldering iron for soldering purpose.

Figure 3:
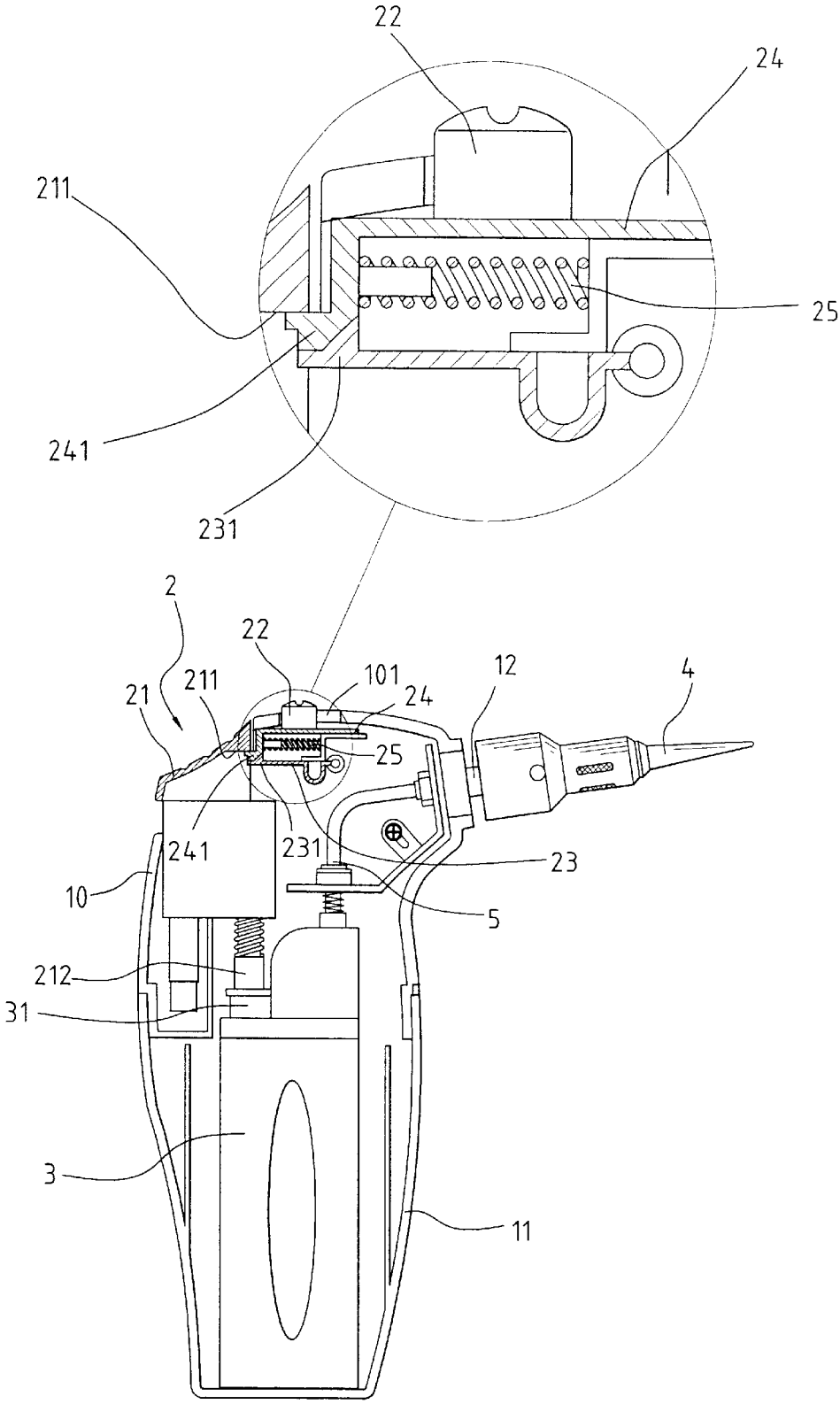
FIG. 3 is a cutaway sectional view of this invention.

In FIG. 3, a fuel duct 5 is disposed in the housing 1 of an ignition gun of this invention and extended to outside of the housing 1 to connect with the flame spout 12 sleeve-jointed to the soldering iron head 4, such that a fuel outlet of the gas lighter 3 is exactly facing and jointed to the bottom end of the fuel duct 5 after the gas lighter is placed in the bottom casing 11.

The space in the knob 21 of the top casing 10 is emptied. A depression rod 212 is located under the knob 21, wherein the bottom end of the depression rod 212 is positioned corresponding to an ignition switch 31 of the gas lighter 3. The push button 22 is combined with a base 24, which is assembled in the top casing 10 of the housing 1, meanwhile, the push button 22 is extended and inserted to a groove 101 on the top casing 10 such that the base 24 can move relatively to the housing 1 of the ignition gun.

A projecting portion 241 is formed at an end of the base 24 and a spring 25 is arranged between the base 24 and the housing 1 structure of the ignition gun. In the case no external force is applied, the elastic force of the spring 25 is acting upon the base 24 such that the projecting portion 241 confronts against a bottom edge 211 of the knob 21 to thereby prevent the knob from being depressed to ensure no trigger mistakenly. Besides, agreed piece 23 is fixedly disposed in the top casing 10, wherein a barb 231 is formed at one end of the reed piece 23, and the barb 231 is likely to contact the rear end of the projecting portion 241 thoroughly.

Figure 4:
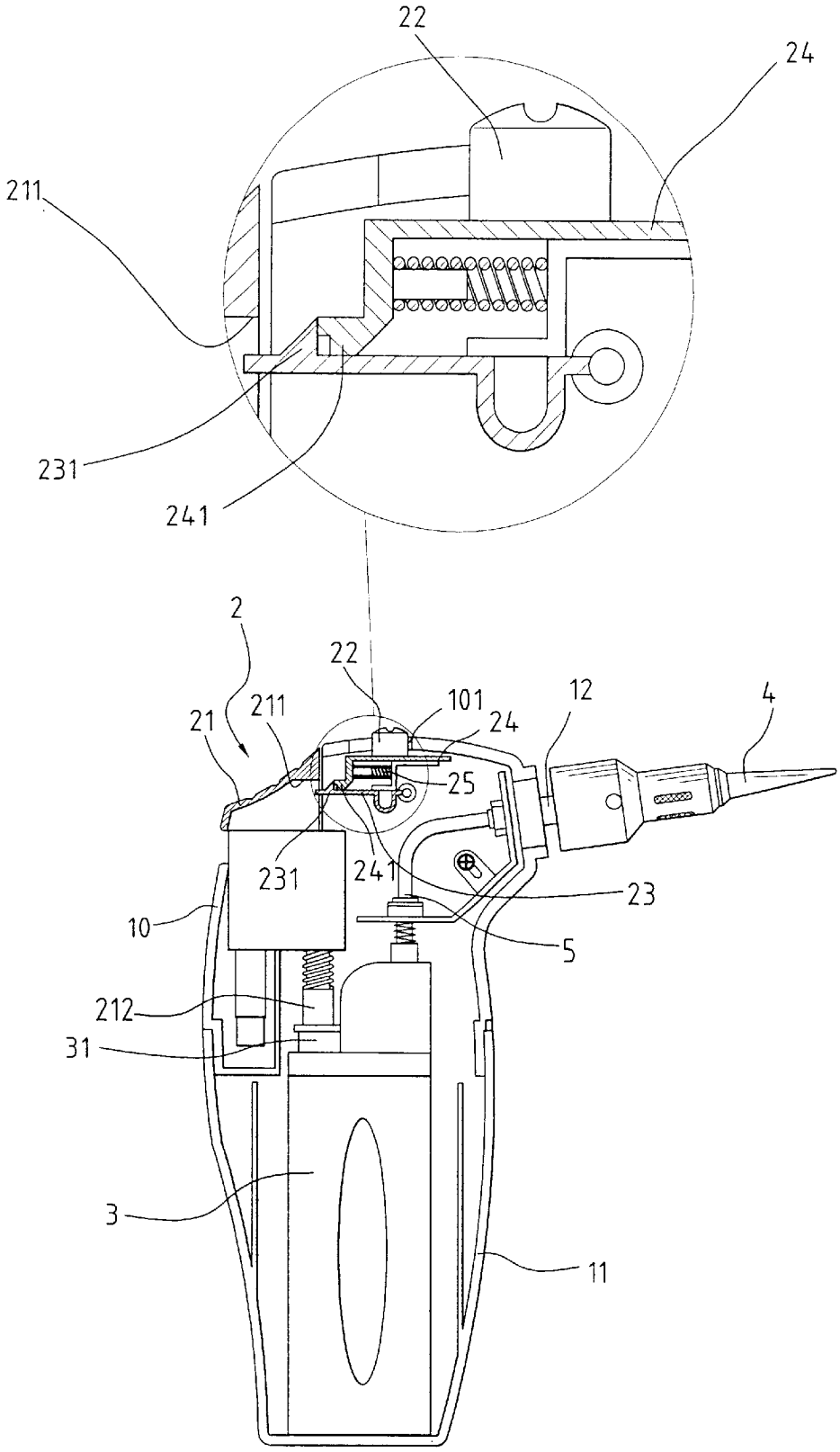
FIG. 4 shows that a push button of the safety device of this invention is pushed forward.
Figure 5:
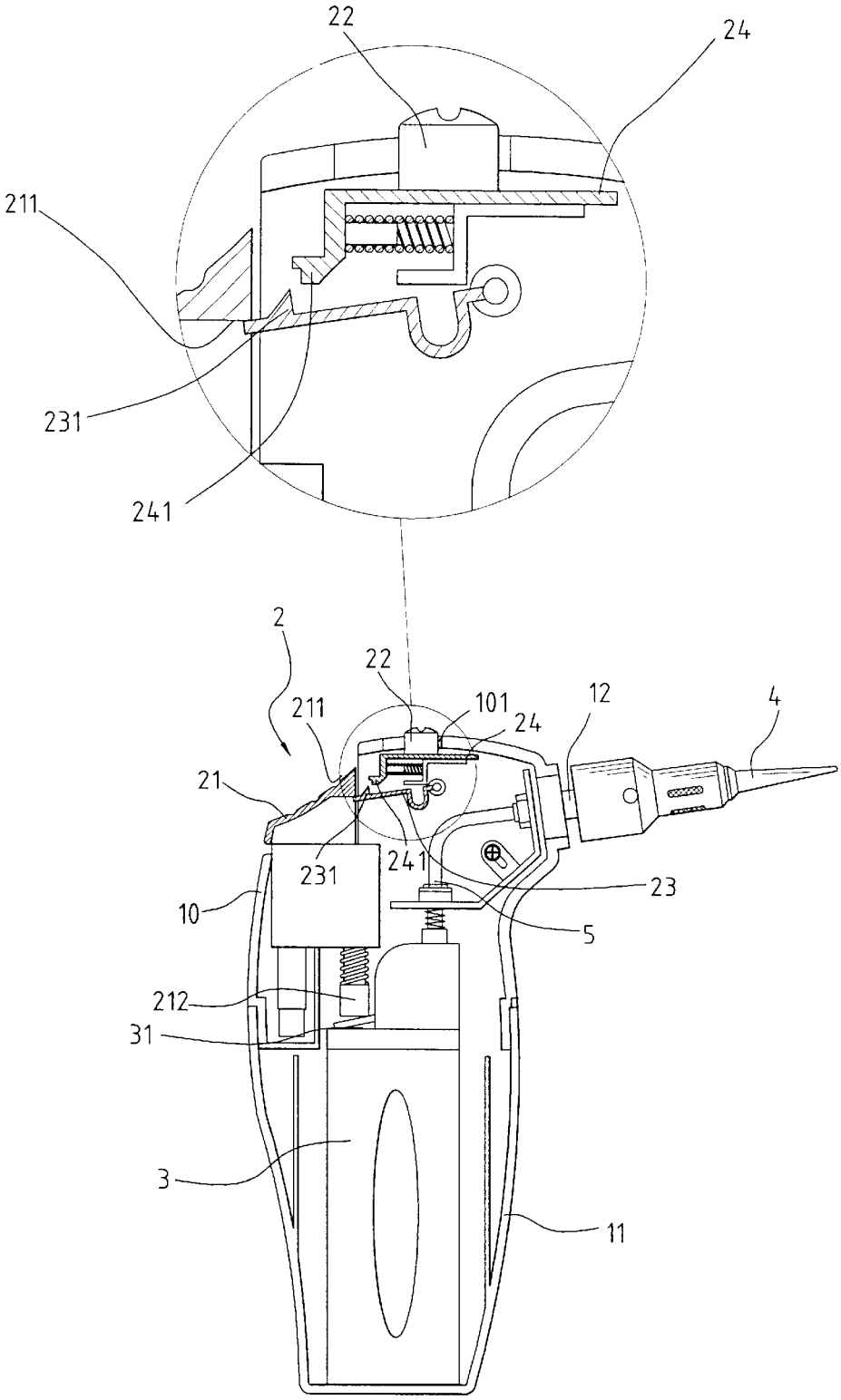
FIG. 5 is a cutaway sectional action view showing that a knob is depressed downwards under the state shown in FIG. 4.

When ignition is desired, a user is supposed to push firstly the push button 22 forwards (shown in FIG. 4) along the direction pointing the soldering iron head 4 until one end of the projecting portion 241 has departed from the bottom edge 211 of the knob 21 and is checked by the barb 231 of the reed piece 23 to prevent the push button 22 from being restored. Then, the user should depress the knob 21 (shown in FIG. 5) such that the depression rod 212 will drive the ignition switch 31 of the gas lighter 3 to have the inside fuel delivered through the fuel duct 5 for kindling, and the flame spouted is to heat the soldering iron head.

Figure 6:
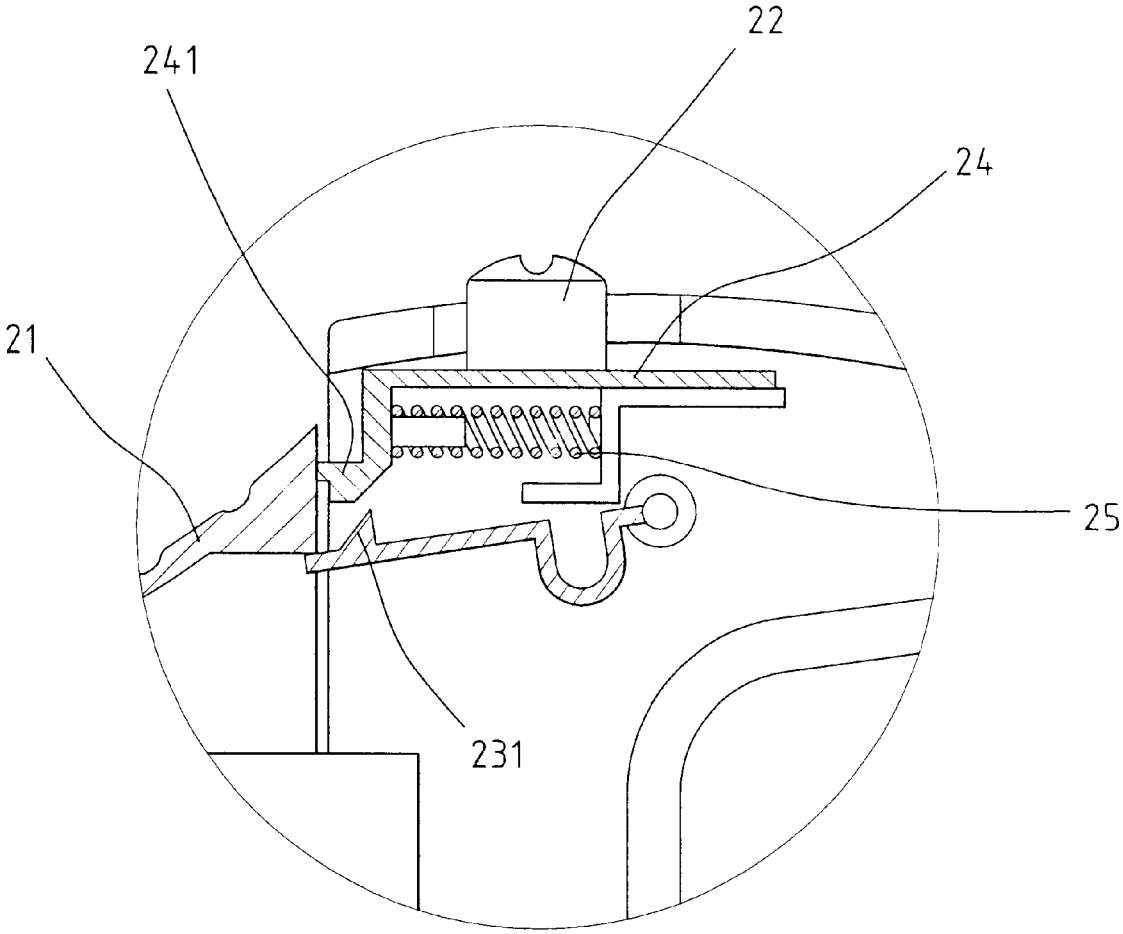
FIG. 6 is a partially enlarged view showing that, after depression of the push button, the pushed knob shown in FIG. 5 is restored by a spring.

In the depression travel of the knob 21, as the reed piece 23 is down-pressed simultaneously, the barb 231 would escape from the checking of the projecting portion 241 (shown in FIG. 6) such that the spring 25 will act on the base 24 to restore the push button 22 for operation next time. When depressing the knob 21 again is desired, the user has to repeat abovesaid procedure to ensure operation safety of the ignition gun.

In the above described, at least one preferred embodiment has been described in detail with reference to the drawings annexed, and it is apparent that numerous variations or modifications may be made without departing from the true spirit and scope thereof, as set forth in the claims below.

What is claimed is:

1. A safety device for ignition gun, comprising:

a housing of an ignition gun;

a knob disposed on the housing, being slidable relatively to the latter;

a push button combined with a base, in which the base is assembled in the housing and is also slidable relatively to the latter; a projecting portion is formed at one end of the base; and a spring is arranged between the base and the housing structure such that the projecting portion would confront against a bottom edge of the knob by taking advantage of the elastic force of the spring applied to the base under normal conditions to make the knob non-depressible; and a reed piece fixedly disposed in the housing, having a barb;

whereby an end face of the projecting portion is checked by the barb of the reed piece if one pushes the push button to a proper position to release the projecting portion from the bondage of the knob such that the knob would become free for depression; and during a depression travel of the knob, the reed piece is depressed to let go of the barb from the checking of the projecting portion to restore the push button to its original position by the restoring force of the spring applied upon the base.

* * * * *